United States Patent [19]

Bashark

[11] 3,936,904

[45] Feb. 10, 1976

[54] VACUUM CLEANER CLOGGED CONDITION INDICATOR

[75] Inventor: Larry Thomas Bashark, St. Joseph, Mich.

[73] Assignee: Whirlpool Corporation, Benton Harbor, Mich.

[22] Filed: June 3, 1974

[21] Appl. No.: 475,974

[52] U.S. Cl. ..... 15/339; 15/319; 15/327 R

[51] Int. Cl.[2] ..... A47L 9/28

[58] Field of Search ..... 15/339, 319, 327 R; 337/1–8, 19, 23

[56] References Cited

FOREIGN PATENTS OR APPLICATIONS 1,238,309 7/1971 United Kingdom ..... 15/339

*Primary Examiner*—Richard E. Aegerter
*Assistant Examiner*—Larry Jones
*Attorney, Agent, or Firm*—Wegner, Stellman, McCord, Wiles & Wood

[57] ABSTRACT

A vacuum cleaner having an indicator for indicating an undesirable clogged condition of a dirt-collecting structure thereof. The indicator includes a control having a heater and a thermally responsive device responding to heat transferred from the heater to operate an observable indicator carried by the vacuum cleaner when a substantially clogged condition of the dirt-collecting means occurs. Operation of the indicator by the thermally responsive device is prevented as long as the dirt-collecting structure remains substantially unclogged as a result of the cooling action of air being flowed through the vacuum cleaner.

11 Claims, 4 Drawing Figures

Fig. 1.
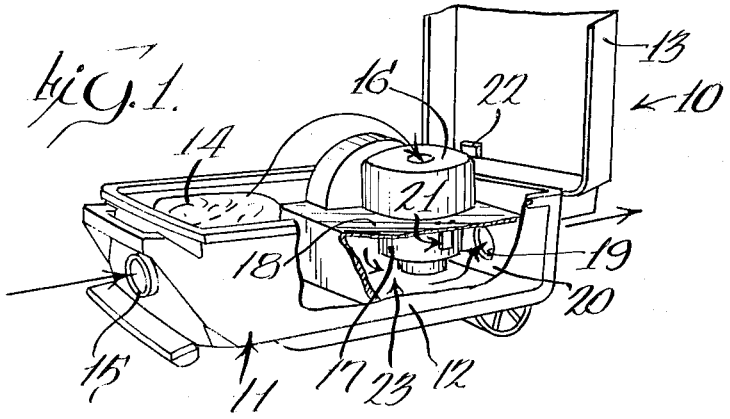
Fig. 2.
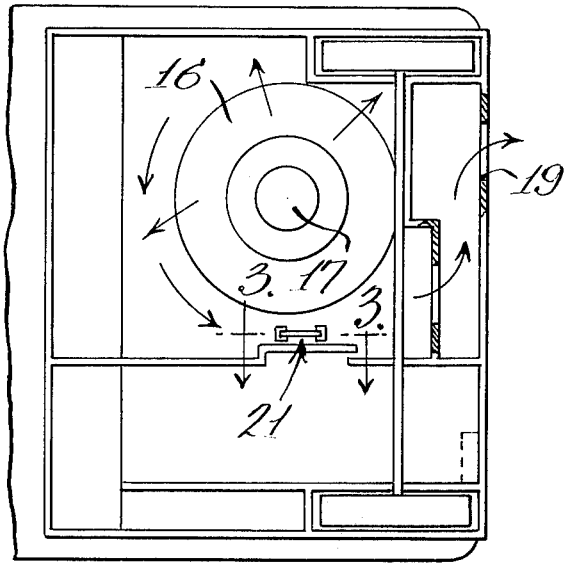
Fig. 3.
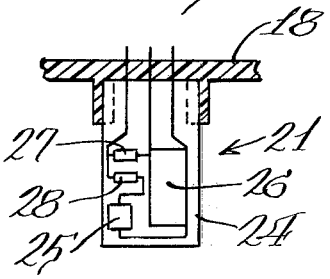
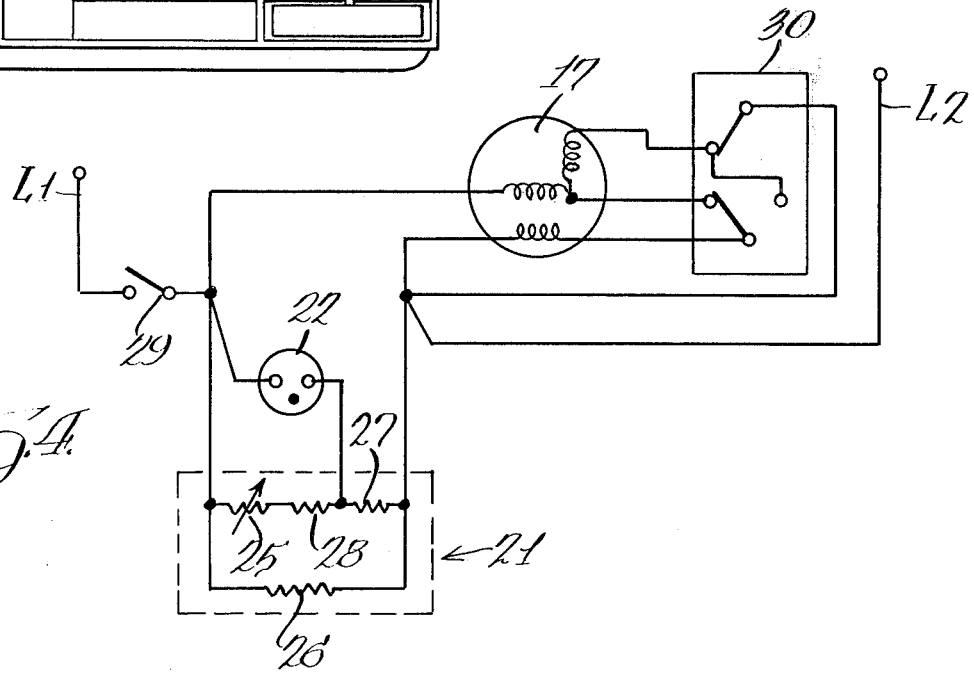
Fig. 4.

VACUUM CLEANER CLOGGED CONDITION INDICATOR

BACKGROUND OF THE INVENTION

1. Field of the Invention

This invention relates to vacuum cleaners and in particular to means for indicating a condition of operation of a vacuum cleaner.

2. Description of the Prior Art

In the conventional vacuum cleaner, air is sucked by a suitable suction means to pick up dirt from a surface being cleaned. The air with the entrained dirt is flowed through a dirt-collecting means conventionally in the form of a porous bag which removes the entrained dirt and passes the cleaned air back to the atmosphere. The air suction means is conventionally powered by an electric drive motor. The power consumption of the motor varies as the bag pressure on the suction means. Such bag pressure conventionally increases as the dirt-collecting means becomes more and more filled with dirt until, in a substantially clogged condition, the bag pressure may be sufficient to cause the power consumption of the motor to overheat the motor and cause possible damage to the vacuum cleaner.

To avoid such damage, a number of devices have been developed which automatically terminate operation of the drive means when the dirt-collecting means becomes substantially clogged. One such structure is shown in U.S. Pat. No. 2,715,452 of Moss A. Kent. Another such structure is shown in U.S. Pat. No. 3,510,904 of Robert C. Lagerstrom. In each of these patents, the temperature of the air as heated by the electric drive means is sensed by a suitable thermostat to open the circuit to the drive means motor.

In another form of vacuum cleaner device, the prevention of overheating of the motor is effected by means of a pressure switch. Such pressure switch controls, however, have the disadvantage of nuisance operation as a result of use of bayonet cleaning tools and the like which tend to restrict the air flow in the normal operation of the vacuum cleaner notwithstanding a substantially unclogged condition of the dirt-collecting means.

SUMMARY OF THE INVENTION

The present invention comprehends an improved control means for use in effectively preventing damage to the vacuum cleaner drive motor as by a clogging of the dirt-collecting means. More specifically, the invention comprehends providing such an improved safety device wherein an indicator is caused to operate the dirt-collecting means is substantially clogged to warn the operator of the condition.

The improved control includes a thermally responsive device for causing selective operation of the indicator and a heater having a preselected thermal capacity for transferring heat to the thermally responsive device. The control is arranged so that when the air flow through the vacuum cleaner is sufficiently high, operation of the indicator by the thermally responsive device is prevented. However, when the dirt-collecting means becomes sufficiently clogged to lower the air flow sufficiently to permit the heater to heat the thermally responsive device to a preselected temperature, the indicator is operated so as to warn the user of the clogged condition of the dirt-collecting means.

In the illustrated embodiment, the indicator utilizes a thick film substrate carrying the heater and thermally responsive device for providing a variable voltage to control an indicator neon lamp. The thermally responsive device may comprise a positive temperature coefficient resistor chip mounted on the thermally conductive substrate which carries, in addition to the heater and thermally responsive device, suitable additional resistors for providing a desired highly accurate control of the indicator lamp operation as a function of the air flow through the vacuum cleaner. The control resistors may be arranged to provide a pre-biasing of the variable resistor chip so that a relatively small change in the resistance thereof may change the applied voltage to the indicator lamp from a nonoperating voltage to an operating voltage.

The indicating means of the present invention is extremely simple and economical of construction while yet providing the highly desirable improved functioning discussed above.

BRIEF DESCRIPTION OF THE DRAWING

Other features and advantages of the invention will be apparent from the following description taken in connection with the accompanying drawing wherein:

FIG. 1 is a fragmentary perspective view of a vacuum cleaner provided with an indicating means embodying the invention;

FIG. 2 is a bottom plan view thereof;

FIG. 3 is a fragmentary enlarged section taken substantially along the line 3—3 of FIG. 2; and FIG. 4 is a schematic diagram of the circuitry of the vacuum cleaner means.

DESCRIPTION OF THE PREFERRED EMBODIMENT

In the exemplary embodiment of the invention as disclosed in the drawing, a vacuum cleaner generally designated 10 is shown to comprise a housing 11 including a base portion 12 and a cover 13 cooperatively enclosing a dirt-collecting bag 14. Air is drawn into the bag through an inlet 15 in base 12 by means of a blower, or fan, 16 driven by a suitable electric drive motor 17 mounted on a support wall 18 in the base. The filtered air is discharged around the drive motor 17 and outwardly through an outlet 19 in the rear wall 20 of the base.

As discussed above, clogging of the dirt-collecting bag 14 may provide a back pressure to the suction means tending to overheat drive motor 17 when the bag reaches a substantially clogged condition.

The present invention comprehends an improved control generally designated 21 comprising an indicating means for indicating to the user the substantially clogged condition of the dirt-collecting bag. As shown in FIG. 1, an indicator illustratively comprising an indicator lamp device 22 may be mounted in the cover 13. Operation of lamp 22 is effected when the dirt-collecting bag 14 becomes substantially clogged so as to indicate to the user the need for removing the dirt laden bag before overheating the drive motor 17.

Control 21 is disposed in the outlet chamber 23 between motor 17 and outlet opening 19 in the path of air flow therebetween so as to be responsive to the temperature and velocity of the exhaust air.

As best seen in FIGS. 3 and 4, control 21, in the illustrated embodiment, comprises a thick film device including a thermally conductive substrate 24 carrying a positive temperature coefficient resistor chip 25 closely adjacent a heater 26 so as to be in thermal conductive association therewith. Also carried on the substrate element 24 are a ballast resistor 27 and a stabilizing resistor 28. As shown in FIG. 3, at least one of the heater 26, variable resistor 25, and substrate 24 are disposed in thermal transfer association with the flowing air, and as shown, the entire control 21 is so disposed.

The operation of control 21 is best seen with reference to FIG. 4 wherein the variable resistor chip 25 is connected in series with the stabilizing resistor 28 and the ballast resistor 27 across power supply leads L1 and L2 when the On-Off switch 29 of the vacuum cleaner is closed. As shown, the drive motor and two-speed switch 30 are connected in series with the On-Off switch 29 for driving the suction means 16 in the operation of the vacuum cleaner selectively at lower or higher speeds.

In the illustrated embodiment, the indicating lamp 22 comprises a conventional neon lamp which is connected from switch 29 to between resistors 27 and 28. Heater 26 is connected between switch 29 and power supply lead L2 to complete the control circuitry. Variable resistor 25 illustratively may comprise a Sprague No. 3042709 PTCR chip having a switching temperature of approximately 105°C. adapted to change in resistance at that temperature from a cool resistance of 3.3k ohms to a hot resistance of approximately 1 megohm. Stabilizing resistor 28 may comprise a 17 k ohm resistor and ballast resistor 27 may comprise 21.1k ohm resistor to provide selective operation of the neon lamp 22 when the temperature sensed by the variable resistor 25 reaches approximately 105°C.

As indicated, the substrate 24 comprises a thermally conductive substrate so as to conduct heat from heater 26 to the variable resistor 25 for improved sensitivity. Air flowing in heat transfer association therewith maintains the resistor 25 below the resistance change-over temperature as long as the dirt-collecting bag 14 remains substantially unclogged. However, when the dirt-collecting bag becomes substantially clogged, the dissipation of heat from heater 26 is sufficiently lowered to permit variable resistor 25 to sense a temperature in excess of approximately 105°C., and thereby switch to its high resistance condition providing firing voltage to the neon lamp 22 and thereby causing an indication to the user of the clogged bag condition.

The ballast resistor 27 effectively limits the current through the fired neon lamp to the necessary safe value.

The stabilizing resistor 28 effectively pre-biases the circuit so that the voltage applied to neon lamp 22 when the variable resistor 25 is in the low resistance state is only slightly less than the firing voltage. Thus, a relatively small change in the resistance of the resistor 25 immediately fires the lamp 22 to provide the desired clogged bag indication.

Stabilizing resistor 28 further minimizes the effect of variation in the firing voltages of different neon lamps and effectively eliminates flickering of the lamp once it is turned on.

As will be obvious to those skilled in the art, the specific heating capacity of heater 26 may be correlated with different power drive motors 17 to provide optimum indicating functioning. Preferably, the heater 26 is selected so as to permit maximum power to be developed by the motor 17 with a normal maximum restriction at the inlet 15, such as may be caused by the use of a crevice tool connected to the inlet, without causing the indicating lamp 22 to light. Thus, control 21 maximizes sensitivity while yet minimizes possibility of nuisance cycling as may be caused by a substantial restriction to the inlet such as by the use of a crevice tool.

It has been found that the use of control 21, including heater 26 for controlling the resistance of variable resistance 25 and thus the operation of neon lamp 22, provides a substantially greater sensitivity than that obtained with conventional pressure switch indicators. As will be obvious to those skilled in the art, maximum sensitivity may be obtained by adjusting the resistors 27 and 28 for accurate specific correlation with the other parameters of the specific circuit. The resistors, as discussed above, may comprise thick film resistors on substrate 24 and, thus, may be easily and economically adjusted to accuracies of ± ½% by using a standard laser trimming operation.

Control 21 may be adjusted for use with any suitable size vacuum cleaner motor. Illustratively, highly accurate control of such motors has been obtained in actual practice where the motors have been rated at 1hp. and 2.8 hp. with heater resistors of approximately 2.0k ohms and 3.3k ohms, respectively, by suitable selection of the control circuit parameters. Similarly, other size motor drives may be similarly controlled.

Control 21 functions equally well when the motor is operated on either high or low speed. The PTC resistor 25 switching temperature and heater resistor 26 resistance value may be selected such that the net cooling effect of the higher speed, higher temperature air is substantially equal to that of the lower speed, lower temperature air when the dust bag is full.

Control 21 eliminates the need for any moving parts in controlling the operation of the indicating lamp 22 and as the air flowed in heat transfer association therewith is substantially completely unobstructed, as illustrated in FIGS. 1 and 2, no clogging of the control portion of the air flow system occurs so as to maintain the indicating means highly accurate with minimum servicing requirements. Changes in the suction-producing ability of the air moving means of the vacuum cleaner do not affect the functioning of the control 21 so that desired indication of the clogged bag condition is maintained throughout the life of the vacuum cleaner.

The foregoing disclosure of specific embodiments is illustrative of the broad inventive concepts comprehended by the invention.

Having described the invention, the embodiments of the invention in which an exclusive property or privilege is claimed is defined as follows:

1. In a vacuum cleaner having an air suction means including drive means, collecting means for removing entrained material from air flowed therethrough by said suction means, and means for conducting said air in heat transfer association with the drive means for cooling the drive means, means for indicating an undesirable clogging of the collecting means comprising: electrically operable indicator means carried by said vacuum cleaner; thermally responsive means for operating said indicating means when the thermally responsive means is heated to above a preselected temperature including a positive temperature coefficient resistor electrically connected to said indicator means for varying the effective voltage applied thereto; heater means having a preselected heating capacity for heating said thermally responsive means to above said preselected temperature; and thermally conductive means mounting said heater means and thermally responsive means in heat transfer association, at least one of said heater means and said thermally responsive means being in heat transfer association with the sucked air subsequent to its conduction in heat transfer association with said drive means for maintaining the thermally responsive means at a temperature below said preselected temperature when the collecting means is substantially unclogged whereby said indicating means is precluded from operating and thereby indicate the substantially unclogged condition of said collecting means, and permitting the heater means to heat said thermally responsive means to above said preselected temperature when the collecting means is substantially clogged whereby said indicating means is caused to operate and thereby indicate the substantially clogged condition of said collecting means.

2. The vacuum cleaner clogging indicating means of claim 1 wherein said heater means is disposed closely adjacent said thermally responsive means.

3. The vacuum cleaner clogging indicating means of claim 1 wherein said heating capacity of said heater means is preselected as a function of the power rating of the drive means.

4. The vacuum cleaner clogging indicating means of claim 1 wherein said thermally responsive means is carried in closely spaced relationship on said thermally conductive means.

5. The vacuum cleaner clogging indicating means of claim 1 wherein means are provided for mounting both said heater means and said thermally responsive means in heat transfer association with said sucked air.

6. The vacuum cleaner clogging indicating means of claim 1 further including a stabilizing resistor and ballast resistor in series with said positive temperature coefficient resistor, said positive temperature coefficient resistor and series connected stabilizing resistor being connected in parallel with said indicator means.

7. The vacuum cleaner clogging indicating means of claim 1 wherein said indicating means comprises a neon lamp.

8. The vacuum cleaner clogging indicating means of claim 1 wherein said indicating means comprises a neon lamp and said thermally responsive means further includes a stabilizing resistor and ballast resistor in series with said positive temperature coefficient resistor, said positive temperature coefficient resistor and series connected stabilizing resistor being connected in parallel with said lamp.

9. The vacuum cleaner clogging indicating means of claim 8 wherein said stabilizing resistor is preselected to cause the voltage applied across the lamp to be slightly less than the firing voltage when said collecting means is substantially unclogged.

10. The vacuum cleaner clogging indicating means of claim 1 wherein said positive temperature coefficient resistor comprises a chip element electrically conductively secured to said thermally conductive means.

11. In a vacuum cleaner having an air suction means including drive means, collecting means for removing entrained material from air flowed therethrough by said suction means, and means for conducting said air in heat transfer association with the drive means for cooling the drive means, means for indicating an undesirable clogging of the collecting means comprising: indicator means carried by said vacuum cleaner; thermally responsive means for operating said indicating means when the thermally responsive means is heated to above a preselected temperature; heater means having a preselected heating capacity for heating said thermally responsive means to above said preselected temperature; and thermally conductive means mounting said heater means and thermally responsive means in heat transfer association with at least one of said heater means and said thermally responsive means being in heat transfer association with the sucked air subsequent to its conduction in heat transfer association with said drive means for maintaining the thermally responsive means at a temperature below said preselected temperature when the collecting means is substantially unclogged whereby said indicating means is precluded from operating and thereby indicate the substantially unclogged condition of said collecting means, and permitting the heater means to heat said thermally responsive means to above said preselected temperature when the collecting means is substantially clogged whereby said indicating means is caused to operate and thereby indicate the substantially clogged condition of said collecting means, said thermally conductive means comprises a substrate element and said thermally responsive means includes a plurality of resistors comprising thick film resistors on said substrate.

* * * * *